US005284515A

United States Patent [19]

Chang

[11] Patent Number: 5,284,515

[45] Date of Patent: Feb. 8, 1994

[54] COATING MACHINE FOR WATERPROOF OF PAPER BASED ARTICLES

[76] Inventor: Tsung-Yen Chang, Suite 1, 11F, 95-8 Chang Ping Road Sec. 1, Taichung, Taiwan

[21] Appl. No.: 870,289

[22] Filed: Apr. 17, 1992

[51] Int. Cl.[5] ..... B05C 1/12

[52] U.S. Cl. ..... 118/64; 118/250; 118/261; 118/263

[58] Field of Search ..... 118/64, 65, 248, 249, 118/250, 261, 263, 258, 262

[56] References Cited

U.S. PATENT DOCUMENTS 1,323,371 12/1919 Merrick ..... 118/249

1,417,195 5/1922 Morrison ..... 118/250

1,739,499 12/1929 Beckwith ..... 118/250

2,615,422 10/1952 Ackley ..... 118/249

*Primary Examiner*—Matthew O. Savage

[57] ABSTRACT

An apparatus for applying a waterproof coating material to paper based articles is disclosed herein. The apparatus includes a main frame, a coating roller, a guide roller, and a disk to which the coating and guide rollers are mounted. Means are provided to rotatably mount the disc to the frame so that the coating roller may be inserted or withdrawn from a sink containing the coating material. A drive system for driving the rollers as well as a hot air drying system for drying coated articles are also provided.

1 Claim, 4 Drawing Sheets

COATING MACHINE FOR WATERPROOF OF PAPER BASED ARTICLES

BACKGROUND OF THE PRESENT INVENTION

The present invention relates to a waterproofing device, particularly to a coating machine applying waterproof process for paper based documents and photos.

People being in modern society must have experienced a lot of personal historical events to be commemorated, especially those of which was already taken pictures or which was taken record in documentations. They hope that these precious historical records regarding to themselves would be long lasting for their own reference in old age or to be inherited by their descendant generation after generation.

However, those paper based records are difficult to maintain under the hot and damp atmosphere. Thus, the colorful pictures are faded out after keeping a certain period of time, so as those precious paper documents are cracked eroded or wormed. It is a mischief for a owner of the record to face the intolerable loss.

Solution has been made simply by using liquidized glue sprayed on the surfaces of those paper based records manipulately in order to prevent it from deterioration. But the rough result is unacceptable because the uneven dried glue on the surface makes the pictures or doucments obscure or invisible.

Equivalent machinary of prior art has been manufactured similar to this invention of a coating machine of the type to facilitate people applying transparent liquidized glue instead of the manual spraying on the surfaces of the commemorative records. But these coating machines possess a lot of structure defficiencies, particularly that the laminar cylinder of these machine is made firmly secured on the pivot of a frame and can not be disassembled freely. Additionally, the immersion level of that cylinder into the liquidized glue sink is not adjustable. The laminar cylinder should cleaned up with some sort of thinner right after a phase of operation or it would be firmly coated with the quick drying liquidized glue. This critical disadvantage of the structure defficiency on the conventional art which is the original cause among others to have the machine to be damaged is pending for a solution.

SUMMARY OF THE PRESENT INVENTION

The main objective of the present invention is providing a structure improved waterproof coating machine for paper based document and photos of the type which can be evenly applying the liquidized glue on the surface of the working sheets and the amount of glue on a sheet is controllable. Especially, the immusion level of the laminar cylinder into the glue sink is adjustable for a newly designed rotatable disk on which the cylinder being pivotedly supported. Furthermore, the laminar cylinder can be completely left up from the sink easily by an extreme rotation of the disk for a prompt clean-up.

Accordingly, the present invention comprises a main body, a drive system, a coating system and a heat drying system which are installed respectively on a bracket and enclosed in a metallic housing. The dynamic power of this machine is generated by a motor and drived by an encircling chain in cooperated with a plurality of gear wheels and cam arbors, except the heat drying system to which the electric current is supplied through separate channel of cord and conductor.

the coating system includes a laminar cylinder, a guide roller a glue sink and a film thickness controlling assembly which are all made independent and adjustable. Except the laminar cylinder can be pulling up and down or completely left up out of the glue sink upon the greatest rotation of the disk, both the guide roller and the film thickness controlling assembly are easily assembled or disassembled by fastening or unfastening a couple of screws. Besides, the guide roller can be put inwardly or outwardly toward the laminar cylinder to form a guide screed fittable to the working sheets and the inclined angle of the squeegee plate against the surface of the laminar cylinder on the film thickness controlling assembly can be variable to control the uniform amount of the glue liquid on the surface of the laminar cylinder.

The heat drying system includes a couple of electric heating bars and two fans which is positioned far below the glue sink such that the heat waves will be blown out though the outlet in front of the machine and will not affect the liquidized glue to be solidified in the sink at all.

In substantial operation, the working sheet such as a paper based document or a photo is fed in through the feeder inlet on the top housing of the maching. Then, it will be led to the guide screed between the guide roller and the laminar cylinder and goes continuously with facing to the laminar cylinder. Because the roller and cylinder are rotated inversely and that the surface of the laminar cylinder is evenly dipped in the liquidized glue, the working sheet will be applied on full of the liquidized glue soon as it being passing the screed. The working sheet will be dropped down on a slope having a slippery surface right after passed through the screed and slid into a collecting chamber in where the liquidized glue being applied on its surface is to be dried out by the heat wave immediately.

After an operational phase, the guide rollar and the film thickness controlling assembly will be easily dismounted from the their support bars, the residual liquidized glue will be leaked out into a container bringing in and out through the side door, and laminar cylinder will be lifted up by rotating the rotatable disk. The above components are cleaned-up with a piece of gauze soaked with thinner before resetting for the next phase of operation.

Apparently, the improved structure of the present invention presents at least the following advantages:

1. It provides a rotatable disk on which the laminar cylinder is pivotedly joined making the cylinder adjustable up and downwardly in the glue sink in order to vary its immersion level. It is therefore that the uniform amount of glue on its surface is under control in cooperation with a squeezee plate, the result on the working sheet should be more qualified.

2. The laminar cylinder can be completely raised up from the sink as the rotatable disk has been extremely rotated by hand, and the other related components are designed to be freely reassembled, thereby providing the machine the feasibility of easier maintenance that the enduring of its durability is otherwise achieved.

Further objects and advantages will become more apparent in a consideration of using detailed description and drawings.

DETAIL DESCRIPTION FOR THE PREFERRED EMBODIMENT OF THE PRESENT INVENTION

Figure 1:
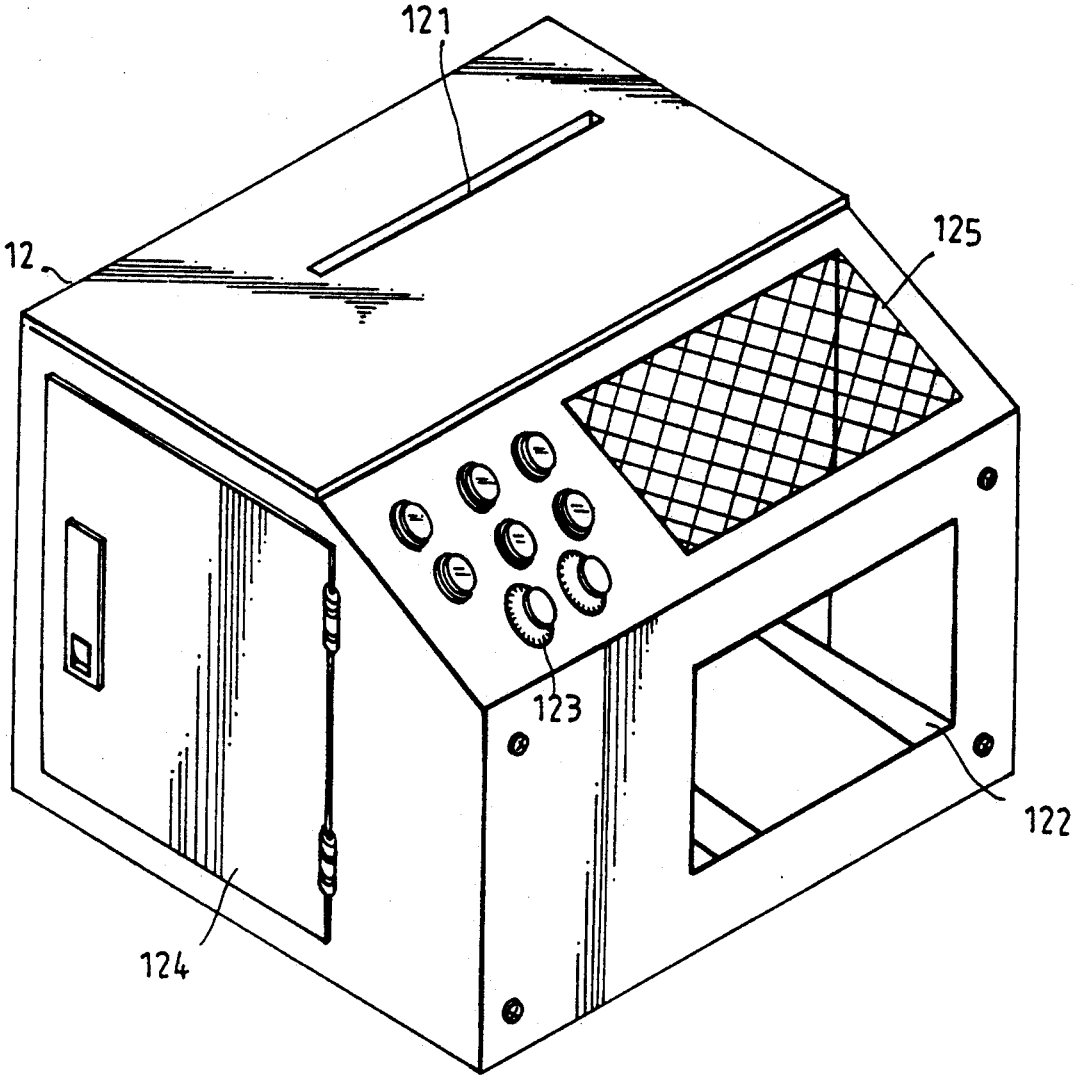
FIG. 1 shows a perspective view illustrating an outward appearance of the preferred embodiment of the present invention.
Figure 2:
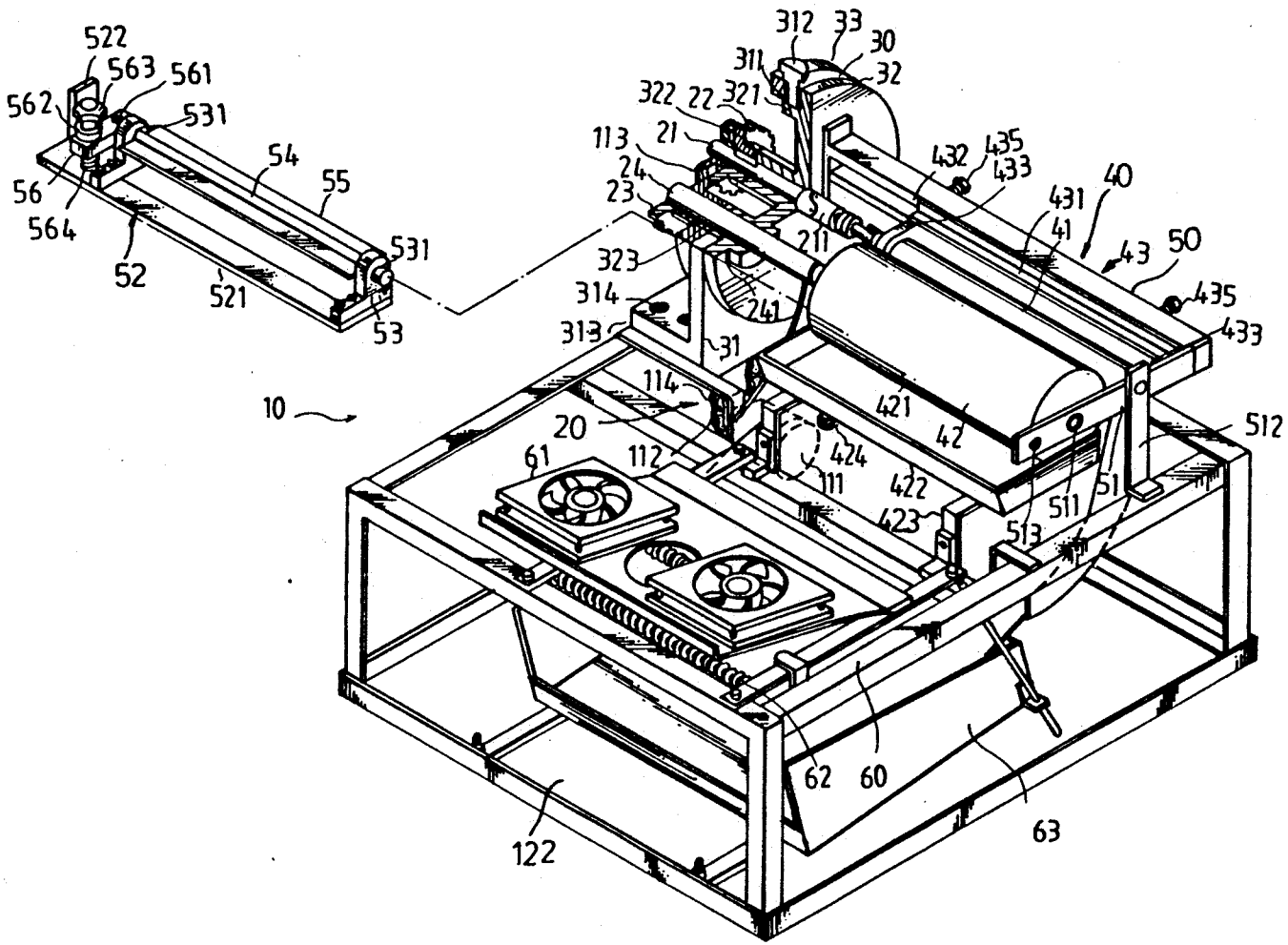
FIG. 2 shows an exploded perspective view for the preferred embodiment of the present invention with partly cut away and partly fragmented.
Figure 3:
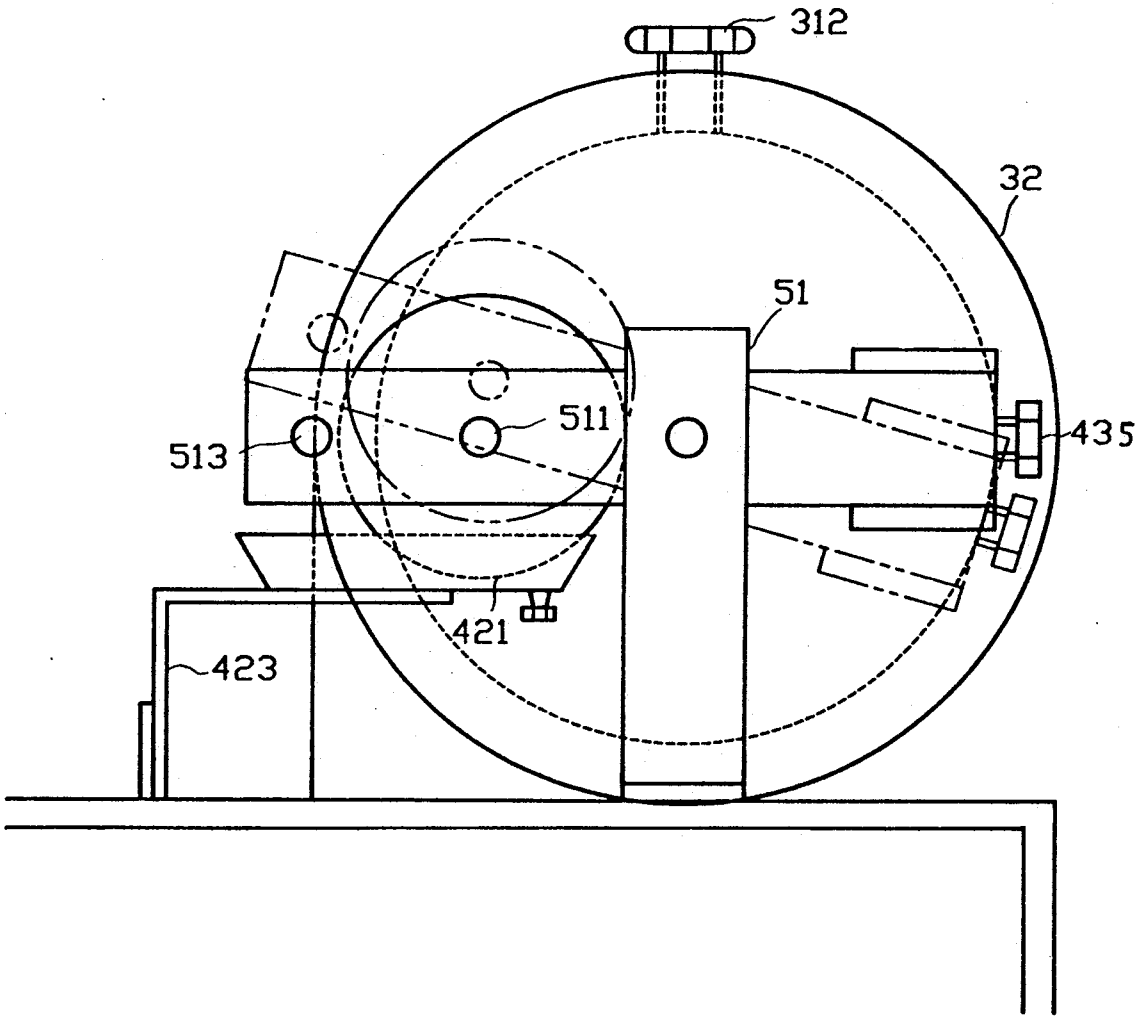
FIG. 3 shows a proceeding plane view illustrating the laminar cylinder being lifted up upon the rotation of the rotatable disk.

Referring to FIG. 1 and FIG. 2, the present invention of a coating machine applying water proof for paper based documents and photos comprises a main body 10, a drive system 20, a coating system 40 and a heat drying system 60.

All above mentioned elements are installed respectively on a metallic bracket and covered with a metallic housing 12 on which includes there a feeder inlet 121, an open outlet 122, a switch and indicators panel 123, a side door 124 and a mesh window 125. Except that the side door 124 is prepared for the inspection of the internal circulation and the collection of the residual liquidized glue from the sink 422, the meshing window 125 is prepared as an aerator for aerial circulation, the upper portion of the housing can be open to facilitate the components being taken in or out of the machine.

The drive activity of the machine is run by an electromotor 111 positioned on the bottom closed to one side of the machine. The drive system 20 includes two similar gear wheels 112, 113 and an encircling chain 114 which carries out the entire rolling activities for the machine. Except that the gear wheel 112 is secured on the axial arbor of the motor and the gear wheel 113 is secured on a propeller shaft 21 enclosed in the journal seat at the center of the rotatable disk 30. A larger stepped gear wheel 22 is secured on the extreme end of the revolving axle 21 adjacent to the gear wheel 113 being cog joined to another stepped gear wheel 23 which is secured on the extreme end of a propller shaft 24 being enclosed in another journal seat 241 disposed along the diameter of the rotatable disk 30.

The guide roller 41 which is suspended on a longer arm 43 of a rotatable frame 43 is connected one end on the disk and another end axially connected on the pivotal through hole on a short arm 51 of the rotatable frame 43 and a vertical shaft 512. Similarly, the laminar cylinder 42 is connected with one end to the propeller shaft 24 and another end being axially connected on the though hole 511 on the short arm 51. A rectangular glue sink 422 being supported by two L shaped bars 423 is positioned right under the laminar cylinder 40. It is removable because of that the two L shaped bars 423 are screw fastened on the bracket 60. The sink 422 has been made a funnel being covered with screw cover 424 to let the liquidized glue leaking out of the sink right after a call-off the process.

The rotatable disk 30 which is formed of two interrelated round flat pieces 32 and 33 is stood up rotatably on a L shaped support 31 in between round interspace 311. An annular band 321 having the diameter less than the round flat piece 32 and a tubular journal seat 322 are extruded from one side of the round flat piece 32 and extended parallel onto or passing though the outer round flat piece 33 in addition to a tubular journal seat 241 being extruded from the opposite side of the round flatpiece 32 extending inwardly to the machine. The outer round flat piece 33 which is made in registry with the inner round piece 32, and on which two round through holes have been made along its diameter to let the tubular journal seat 322 and the propeller shaft 24 passing through is to be firmly joined with the inner round flat piece 32 by couple of screws in order to make a complete flat drum shaped rotatable disk 30 with its annular surface sandwiched in between and rotatable along the periphery of the round interspace 311 on the L shaped support 31. In normal condition, the rotatable disk 30 is keeping stable and locked by a hand drive screw 312 against the annular band 321 on the disk 30.

A L shaped rotatable frame 43 which is prepared to suspend the guide roller 41, the laminar cylinder 421 and the film thickness controlling assembly 52 and which is made in cooperated with the rotatable disk 30 is firmly secured one end on the rotatable disk 30 and extends parallelly across the entire bracket with other end being supported by a vertical shaft 512 standing on the bracket. The guide roller 41 which is axially connected one end on the frame 43 and other end connected on coupling joint 211 to the propeller shaft 21 is under control by two minute adjusting screws 435 set on a movable plate 432 laid on a reinforcement arm formed under the longer arm of the L shaped rotatable frame 43. The adjustment of slight pushing or pulling the roller 41 forewardly or backwardly by the minute adjusting screws 435 is completed through a strip hook being connected between the roller 41 and the movable plate 432 in cooperated with the helical springs. Thus, a gap between the roller 41 and the laminar cylinder 42 is varied upon the movement of the minute adjusting screws 435.

The laminar cylinder 42 is composed of a cylindrical body 421 being axle connected with one end to the propeller shaft 24 and other end being axially connected on the short arm 51 of the L shaped frame 43. Since the rotation movement of the cylinder 42 is led by the propeller shaft 24, its rolling direction is always keeping inversely to the guide roller 41 except their similar rolling speed. Normally, the laminar cylinder 42 keeps its bottom portion immersed in the liquidized transparent polyurethane glue in the glue sink 422 directly under.

A film thickness controlling assembly 52 (shown in a fragnent in FIG. 2) is composed of two L shaped support 53 being screw secured on a rectangular base seat 521 with a round through hole 531 being formed on the central line near the arch end of its standing portion, a sequeegee plate 55 connected along its central line on and axle bar 54 which is pivotedly inserted with two ends into those through hole on each L shaped support 53, a leverage minute adjustment unit 56 being positioned at one end of the axle bar 54 which is combined with a small rectangular plate being one end secured and suspended on a top of the bar 54 through a lateral through hole 56 where a fulcrum for the unit 56 is therefore constituted and other end screwed in against the rectangular base 521 by a hand screw 563 and resisted by a resilient helical spring 564 being wrapped in one end in a hollow circular housing 562 protruded and linked on the top surface of the rectangular plate which is prepared doing so as a lever to turn the squeegee plate 55 for varying inclination angles relatively upon the rotating movement to get the hand drive screw 563 moved up or downwardly, and a rectangular suspending piece 522 being firmly secured on one extremity of the rectangular base 521 of the film thickness controlling assembly 52.

Being assembled, the film thickness controlling assembly 52 is secured one end on the rotatable disk 30 and the other end axially connected on a through hole 513 near one end of the short arm 51 of the L shaped rotatable frame 43. The controlling assembly 52 is therefore led up or downwardly by the rotatable disk 30 and its squeegee plate 55 is disposed with its blade closer to the moistened surface of the laminar cylinder 421 to control exactly the thickness of the liquidized glue covering on it.

The heat drying system comprises two electric fans 61 and two electric heat bars 62 being disposed directly under the fan 61. Both of which are supplied with appropriate electric current by separate cord and conductor (not shown) and controlled by the switches being disposed in the panel 123 on the housing. Additionally, a bottom slant collection chamber 63 is positioned below the heat bars 62 with one side keeping open toward to the outlet 122 of the housing and other side being oblique extending onto the position directly under the guide roller 41. So that the well coated working sheets are dropped directly on the slippery slope surface and slid downwardly and dried out en route to the collection chamber 63. Because of that the heat drying system 60 is structurally far below the coating system 40 and that heat wave is blown out directly through the outlet 122, the liquidized glue should be keeping unaffected in the sink 422.

Based on the aforediscussed structure composition of this coating machine, appropriate preparations should be taken previously to the regular process are as follows:

1. Fill in the liquidized transparent PU glue to the glue sink 422 in appropriate amount.

2. Rotate the minute adjusting screws 435 to and fro on the movable plate 432 to lead the guide roller 41 in or outwardly to get an optimum spacing between the roller 41 and the laminar cylinder 42 for the working sheets to smoothly pass through.

3. Rotate a minute adjusting screw 563 to and fro on the film thickness controlling assembly 52 as the squeegee plate 55 being lead with its blade up or downwardly on the surface of the laminar cylinder 421 until it is fixed on a selected position where can provide required thickness of the liquidized glue on the surface of the working sheet. And reset the immersion level for the laminar cylinder if necessary.

4. Turn on the power switches including the switches for the motor 111 in drive system, the fan 61 and the heat bar 62 in the drying system 60. Let it run for few minutes before the starting of the regular process.

Figure 4:
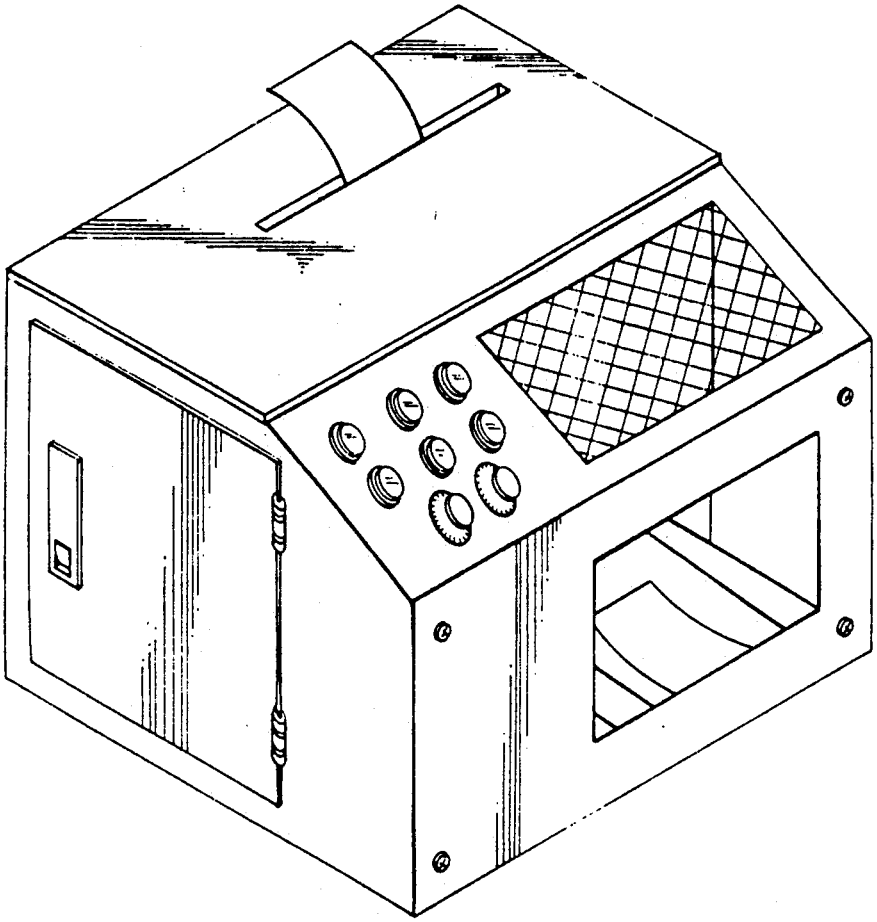
FIG. 4 shows the outward appearance for the preferred embodiment of the present invention during proceeding.

In substantial operation (Referring to FIG. 4), feed a working sheet such as a paper based document or a photo into the feeder inlet 121 on the top of the machine. The working sheet will be lead to the screed in between the guide roller 41 and the laminar cylinder 421 immediately as the edge of the sheet reaching to the guide roller 41. The liguidized PU glue is applying gradually on the working sheet by the laminar cylinder 421 soon as it passing the screed. After it all passed through, the working sheet will be dropped down on a slippery slope surface and slid into the collection chamber directly under the heat drying system. Actually, the coated working sheet is dried out en raute to the collection chamber 63 and the proess only lasts for few seconds at all.

The most characteristic aspect of the present invention over the prior art is of a rotatable disk 30 which can not only adjust the immersion level for the laminar cylinder 421 in the glue sink 422 to make up the squeegee plate 55 of its defficiency, but also lifts the cylinder up completly out of the sink 422 for a thorough clean-up. The process is performed simply by following steps:

1. Firstly turn the power off and unfasten the hand screw 312 on the top of the rototable disk 30 as the disk is released free for rotating.

2. Press down or lift up the longer arm of the L shaped rotatable frame 43 to lead the rotatable disk 30 begins to rotate in between the round interspace 311 on the L shaped stand 1 and centralizing to the propeller shaft 21.

Simultaneously, both the laminar cylinder 42 and the film thickness controlling assembly are lead to move up or downwardly upon the rotating movement of the rotatable disk 30 and the immersion level of the laminar cylinder 30 in the glue sink 422 is therefore decided. Fasten again the hand drive screw 312. When the laminar cylinder 30 has been fixed in a selected position, then the machine is resumed to be stable and ready for next process.

3. After a phase of operation, unfasten the hand drive screw 312 again and press downwardly the longer arm of the L shaped frame 43 to the extreme limit to lead the rotatable disk 30 to be greatly rotated and the laminar cylinder 42 is lifted up all out of the glue sink 422 for a complete clean-up by the gauze dipped with thinner.

As a matter of fact, the conventional transparent liquidized PU glue is of a quite adhesive and quick drying material being applied to this coating machine. It is therefore that the clean-up step among the entire process is rather important. The user must be started soon as the job is done or otherwise the surface of the important components will be rigidly applied of the glue.

Generally, the present invention of a coating machine applying waterproof for paper based documents and photos is of a break-through over the prior art, especially on structure improvement which brought in the benefit of saving man-power and qualitative promotion. The scope of this invention should be determined by appended claims and their legal equivalents rather than by the example given.

I claim:

1. A coating machine for applying a waterproof coating material to paper based articles, comprising:

a main frame;

a first shaft and a second shaft;

a disk including first means for rotatably mounting said first shaft in a center portion thereof and second means for rotatably mounting said second shaft at a location spaced from said center portion, said first and second shafts being mounted parallel to one another and extending perpendicularly from said disk;

an L-shaped member including a leg and an arm, wherein said leg extends parallel to said first and second shafts and said arm extends parallel to said disk, wherein a free end of said leg is fixedly attached to said disk adjacent said first shaft at a point one hundred and eighty degrees from said second shaft relative to said center portion;

first support means for rotatably mounting said disc to a first side of said main frame, wherein said first support means rotatably engages a periphery of said disk, said first support means including means for selectively locking said disk against rotation;

second support means for rotatably mounting said arm to a second side of said frame, wherein the axis of rotation of said disk and said second support means are coaxial;

said first shaft having first and second gears fixedly attached proximate one end thereof;

a guide roller;

means for rotatably mounting said guide roller in parallel spaced relation with said leg;

means for flexibly coupling the other end of said first shaft to one end of said guide roller;

said second shaft having a third gear fixedly attached at one end thereof and a second roller coaxially and fixedly attached adjacent the other end of said shaft;

wherein a portion of said first shaft intermediate said second gear and means for flexibly coupling is rotatably mounted to said disk via said first means for rotatably mounting;

wherein a portion of said second shaft intermediate said third gear and said second roller is rotatably mounted to said disk via said second means for rotatably mounting;

means for rotatably mounting the other end of said guide roller to said arm;

wherein said second gear and said third gear intermesh and said guide roller and said second cylindrical roller are parallel to one another;

wherein said means for rotatably mounting said guide roller includes means for adjusting a spacing between said guide roller and said second cylindrical roller;

a sink for containing a supply of said coating material;

means for mounting said sink such that said second cylindrical roller may be positioned partially within said sink by rotation of said disk and said arm;

plate means mounted adjacent said second roller for controlling a thickness of said coating material on said second roller;

a collection chamber;

duct means communicating proximate said space between said guide roller and said second roller for directing said articles from said spacing to a collection chamber;

means for directing hot air into said collection chamber;

and drive means for driving said first shaft via said first gear.

* * * * *